United States Patent [19]

Schwadtke et al.

[11] Patent Number: 4,717,507

[45] Date of Patent: Jan. 5, 1988

[54] LIQUID DETERGENT WITH FABRIC SOFTENING PROPERTIES

[75] Inventors: Karl Schwadtke, Leverkusen; Eduard Smulders, Hilden; Hans Andree, Leichlingen, all of Fed. Rep. of Germany

[73] Assignee: Henkel Kommanditgesellschaft auf Aktien, Dusseldorf, Fed. Rep. of Germany

[21] Appl. No.: 860,275

[22] Filed: May 5, 1986

[30] Foreign Application Priority Data

May 4, 1985 [DE] Fed. Rep. of Germany ..... 3516091

[51] Int. Cl.[4] ..... C11D 3/32

[52] U.S. Cl. ..... 252/548; 252/8.7; 252/8.75; 252/8.8; 252/174.12; 252/174.16; 252/174.21; 252/525; 252/539; 252/540; 252/544; 252/559

[58] Field of Search ..... 252/DIG. 14, 525, 548, 252/544, 539, 540, 559, 174.12, 174.21, 174.16, DIG. 17, 8.7, 8.75, 8.8

[56] References Cited

U.S. PATENT DOCUMENTS

| | | | |
|---|---|---|---|
| 2,861,956 | 11/1958 | Fernandez | 252/153 |
| 2,943,058 | 6/1960 | Cook | 252/153 |
| 3,697,451 | 10/1972 | Mausner et al. | 252/545 |
| 4,153,570 | 5/1979 | Hennemann et al. | 252/121 |
| 4,416,793 | 11/1983 | Barrat et al. | 252/544 |
| 4,452,717 | 6/1984 | Tai et al. | 252/109 |

FOREIGN PATENT DOCUMENTS

| | | |
|---|---|---|
| 1047973 | 12/1958 | Fed. Rep. of Germany . |
| 1600018 | 10/1981 | United Kingdom . |

OTHER PUBLICATIONS

Soap and Chemical Specialities, "Alkylolamide Detergents," T. H. Kritchevsky, Nov. 1958, pp. 48–50.

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

A liquid, readily pourable detergent concentrate having fabric-softening properties is free from builder salts and contains the following constituents: (a) from about 5 to about 15% by weight of sodium alkylbenzene sulfonate, (b) from about 7 to about 20% by weight of ethoxylated alcohols containing from 12 to 18 carbon atoms in the alcohol residue and from 5 to 10 glycol ether groups, (c) from about 6 to about 16% by weight, based on the weight of the fatty acids used to form the soap, of saturated or monounsaturated fatty acids containing from 12 to 18 C-atoms, present as a water-soluble soap, (d) from about 7 to about 15% by weight of a fatty acid diethanolamide derived from $C_{16}$–$C_{18}$ fatty acids of which at least 50% are monounsaturated, (e) from about 0.2 to about 3% by weight of sequestering agents, (f) from about 5 to about 15% by weight of low molecular weight alcohols and from about 25 to about 45% by weight of water. The ratio by weight of (a) to (b) to (c) to (d) is in the range of 1:(1–2):(1–2):(1.5–2.5).

12 Claims, No Drawings

LIQUID DETERGENT WITH FABRIC SOFTENING PROPERTIES

BACKGROUND OF THE INVENTION

1. Field of the Invention

This invention relates to a liquid detergent which has improved fabric softening properties. The invention particularly relates to a surfactant-containing liquid detergent which also includes fatty acid dietha-nolamides prepared in part from monounsaturated fatty acids. Fabrics washed with the liquid detergent of this invention generally do not require after-treatment with known conditioners.

2. Description of Related Art

There are many known liquid detergent formulations containing relatively large amounts of fatty acid monoor diethanolamides. These ethanolamides are derived from fatty acid mixtures containing a high percentage of $C_{12}$-16 fatty acids, for example coconut oil fatty acids. While these particular alkanolamides increase the detergents' cleaning and foaming power and improve its compatibility with the skin, the detergents themselves provide no conditioning effect to the laundered fabrics. Examples of these detergents include those disclosed in U.S. Pat. Nos. 3,697,451; 4,153,570; 4,298,492; 4,452,717; 2,861,956 and 2,943,058; UK Pat. No. 1,600,018 and German Patent Application No. 1,047,973.

The addition of quaternary ammonium salts to anionic surfactant-containing detergents has been proposed in order to obtain a detergent which simultaneously provides a conditioning effect. Typically, these quaternary ammonium salts contain relatively long chain fatty acid or fatty alkyl residues. However, since the anionic surfactants generally are incompatible with these quaternary ammonium salts or react with the salts to form inactive electro-neutral salts, the desired conditioning effect generally is not obtained.

It is also known that certain stearic acid derivatives of alkylolamides may be used as softening agents in treating textiles (*Soap and Chemical Specialities,* November 1958, pages 48 to 50). However, problems involving the behavior of these compounds when used in surfactant-containing detergents are not addressed. In fact, it has been found that storage stable liquid surfactant-containing detergents cannot be prepared containing an effective amount of these stearic acid derivatives.

The detergents of the present invention, described in detail hereinafter, overcome the above-mentioned disadvantages.

DESCRIPTION OF THE INVENTION

The present invention relates to a liquid detergent comprising:

(a) from about 5 to about 15% by weight of a sodium alkylbenzene sulfonate, the sodium alkylbenzene sulfonate having a linear alkyl group containing from 10 to 14 carbon atoms;

(b) from about 7 to about 20% by weight of a water-soluble ethoxylated alcohol containing from 12 to 18 carbon atoms in the alcohol moiety and from 5 to 10 glycol ether groups;

(c) a water-soluble soap prepared from fatty acids having from 12 to 18 carbon atoms in an amount of from about 6 to about 16% by weight on the basis of the fatty acid content;

(d) from about 7 to about 15% by weight of a fatty acid diethanolamide prepared from fatty acids having from 16 to 18 carbon atoms wherein more than 50% by weight of said fatty acids are monounsaturated;

(e) from about 0.2 to about 3% by weight of a sequestering agent selected from the group consisting of polycarboxylic acid-type sequestering agents, polyphosphonic acid-type sequestering agents and mixtures thereof;

(f) from about 5 to about 15% by weight of a water-miscible organic solvent; and (g) water; wherein the ratio of (a) to (b) is in the range of 1:1 to 1:2, the ratio of (a) to (c) is in the range of 1:1 to 1:2, and the ratio of (a) to (d) is in the range of 1:1.5 to 1:2.5.

The detergents of the present invention are of a class of detergents containing substantially no builder salts.

The percentage of the sodium alkylbenzene sulfonate, component (a), in the detergent is from about 5 to about 15% by weight and preferably from about 6 to 10% by weight. Sodium n-dodecylbenzene sulfonate is preferably used as component (a).

The detergent of the present invention also includes a water soluble ethoxylated alcohol nonionic surfactant. The percentage of the ethoxylated alcohol surfactant, component (b), in the detergent is from about 7 to about 20% by weight and preferably from about 8 to about 15% by weight. Suitable ethoxylated alcohols are those having from 12 to 18 carbon atoms in the alcohol moiety and from 5 to 10 glycol ether groups. A preferred class of these nonionic surfactants for use in the present invention are prepared by ethoxylating fatty alcohols and 2-methyl substituted oxoalcohols. Preferably, the alcohols have 12 to 16 carbon atoms. The desired ethoxylated alcohols are prepared by reacting suitable alcohols with ethylene oxide. The average number of added ethylene oxide groups (EO) is from 5 to 10. Ethoxylated alcohols having an hydrophilic-lipophilic balance (hereinafter "HLB") value of from about 9 to about 14, and preferably having an HLB value of from about 11 to about 13.5, are particularly suitable. An example of a suitable alcohol for preparing an ethoxylated alcohol for use in the detergent of this invention is coconut oil fatty alcohol, from which alcohols containing 10 or less carbon atoms have been separated. The refined alcohol mainly comprises a mixture of lauryl and myristyl (1-tetradecanol) alcohols with small amounts of cetyl and stearyl alcohols. Other suitable ethoxylated alcohols are ethoxylated oxoalcohols and $C_{12}$–$C_{16}$ ethoxylated alcohol mixtures produced by ethylene polymerization. The ethoxylated alcohols for use in the present invention preferably have an average degree of ethoxylation of from 6 to 9.

The next component of the detergent of the present invention is a water-soluble soap prepared from fatty acids having from 12 to 18 carbon atoms. The percentage of soap, component (c), based not on the weight of the soap itself but instead based on the weight of the fatty acid used to form the soap, in the detergent is from about 6 to about 16% by weight and preferably from about 8 to about 15% by weight. Suitable soaps include the sodium and potassium soaps and the alkanolamine soaps, particularly the triethanolamine soaps, of saturated and monounsaturated $C_{12}$–$C_{18}$ fatty acids. Soaps of refined coconut oil fatty acids (i.e. coconut oil fatty acids from which fatty acids containing less than 12 carbon atoms have been separated) and soaps of oleic acid or fatty acid mixtures rich in oleic acid, as well as mixtures of these soaps are particularly suitable by virtue of their low cloud point temperatures. The water-soluble soap component is preferably a mixture of sodium soaps or a mixture of sodium soaps and triethanolamine soaps.

A particularly important ingredient of the detergent of the present invention is the fatty acid diethanolamide. According to the present invention the fatty acid diethanolamide component is prepared from monounsaturated fatty acids having from 16 to 18 carbon atoms and mixtures of $C_{16}$–$C_{18}$ monounsaturated and saturated fatty acids. The mixture of the monounsaturated and saturated fatty acids, however, must contain at least 50% by weight, and preferably at least 65% by weight, of monounsaturated fatty acids. The percentage of the diethanolamide component (d) in the detergent is from about 7 to about 15% by weight, preferably from about 8 to about 15% by weight and most preferably from about 10 to about 12% by weight. Particularly suitable diethanolamides are those prepared from oleic and palmitoleic acid and also mixtures thereof with the corresponding palmitic acid and steric acid derivatives. The diethanolamides may be prepared from fatty acid mixtures obtained by isolating the unsaturated fraction, using known hydrophilic separation techniques, of naturally occuring fatty acid mixtures rich in oleic acid, for example from tallow fatty acid mixtures of tall oil fatty acid mixtures. Suitable fatty acid fractions recovered in this manner contain, for example, from about 50 to 100% by weight, and preferably from about 65 to about 95% by weight, of oleic acid and from 0 to about 50% by weight, and preferably from about 5 to about 35% by weight, of palmitic acid and stearic acid. Technical grade mixtures may also contain small quantities, i.e., up to about 5% of myristic acid.

The ethanolamides prepared from these fatty acids by reaction with diethanolamine are technical grade mixtures normally containing from about 85 to about 95% by weight of an N-acyl compound (amide) and from about 2 to about 10% by weight of an O-acyl compound (ester). They may also contain small quantities, i.e., up to about 5% by weight, of unreacted starting materials, mainly free diethanolamine but also including very small quantities of free fatty acid. These "impurities" do not affect the detergents of this invention, but instead may be regarded as functional constituents, especially since the detergent already contains soap and, in certain preferred embodiments, alkanolamines.

The detergent also includes a sequestering or complexing agent. The percentage of the sequestering or complexing agent, component (e), in the detergent is from about 0.2 to about 3% by weight and preferably from about 0.4 to about 2% by weight. Suitable sequestering agents include polycarboxylic acids and polyphosphonic acids. Suitable polycarboxylic acids include, for example, citric acid, nitrilotriacetic acid, ethylene diamine tetraacetic acid and higher homologs thereof. Suitable polyphosphonic acids include aminotri(methylenephosphonic acid), ethylene diamine tetra(methylenephosphonic acid), diethylene triamine penta(methylenephosphonic acid) and higher homologs thereof. The aforementioned sequestrants may be present as their sodium, potassium and alkanolamine, for example triethanolamine, salt. Particularly preferred sequestrants are citric acid, ethylene diamine tetra(methylenephosphonic acid), diethylene triamine penta(methylenephosphonic acid), and mixtures thereof.

Aside from water, the final required component (f) of the detergent of the invention is a watermiscible organic solvent. The percentage of the watermiscible organic solvent component in the detergent is from about 5 to about 15% by weight, and preferably from about 7 to about 13% by weight. Suitable solvents include, for example, mono-alcohols, glycols, polyglycols and ether alcohols, such as methanol, ethanol, propanol, isopropanol, glycerol, glycol, diethylene glycol, triethylene glycol, low molecular weight polyethylene glycols, propylene glycol, oligomeric propylene glycol ethers and ether alcohols, such as methylpropylglycol, methylbutylglycol and methylethylglycol. Other suitable solvents will be apparent to those skilled in this art. The organic solvent component preferably comprises a mixture of ethanol and propylene glycol in a weight ratio of from 1:4 to 4:1.

Additional constituents which may optionally be advantageously added to the detergents include enzymes, enzyme stabilizers, pH regulators, optical brighteners, hydrotropes, foam inhibitors, dyes, pigments, additives which act as opacifiers and additives which impart a silky luster to the solutions. These are known ingredients in liquid detergents and thus require only a brief description.

Suitable enzymes comprise proteases and amylases obtained in a known manner from fungi, bacteria and mixtures thereof. Examples include enzymes obtained from *Bacillus subtilis* or *Bacillus licheniformis*. Standard commercial enzyme preparations generally contain activators, such as calcium and magnesium salts, diluents and binders. The detergent generally contains from about 0.1 to 1.5% by weight of these enzyme preparations.

The stability of the enzymes may be improved by adding alkanolamines, particularly triethanolamine to the detergent. The triethanolamine is preferably present in excess so as to adjust the pH of the detergent to within the range of about 7.2 to about 9 and preferably from about 7.5 to about 8.5.

Other suitable enzyme stabilizers include low molecular weight acids, such as formic acid, acetic acid and lactic acid, which may be present in the detergent in quantities of from about 0.1 to about 2% by weight and preferably in quantities of from about 0.2 to about 1% by weight, based on the free acid. In view of the basic reaction of the detergents, these acids are present predominantly or entirely in the form of their salts, for example as sodium, potassium or alkanolamine salts.

Suitable optical brighteners include known derivatives of bistriazinyl-4,4'-diaminostilbene-2,2'-disulfonic acid and diphenyl-distryryl-disulfonic acid in the form of water-soluble salts thereof. Examples of suitable optical brighteners include salts of 4,4-bis-(2''-anilino-4''-morpholino-1,3,5-triazinyl-6''-amino)-stilbene-2,2-disulfonic acid, 4,4-bis-(2-sulfostyryl)-diphenyl, 4,4-bis-(4-chloro-3-sulfostyryl)-diphenyl and 4-(4-chlorostyryl)-4-(2-sulfostyryl)-diphenyl.

Suitable foam inhibitors include water-dispersible silicones, for example dimethylpolysiloxanes, which may optionally be modified by adding polyglycol ether groups thereto, and also mixtures of dimethylpolysiloxanes with polysiloxane resins or finely divided silica which is preferably silanized. The detergents may contain from about 0.01 to about 1% by weight of optical brighteners and silicone defoamers.

The water content of the detergents should be adjusted in such a way as to give a homogeneous, readily pourable solution which will not separate due to precipitations. The water content is generally between about 25 and about 45% by weight and preferably between about 33 and 40% by weight.

The detergent of the present invention is distinguished from prior art detergents by its improved detergency and by its favorable softening and feel-improving properties. The detergent is suitable for both laundering textiles by hand and, by virtue of its balanced foaming behavior, for laundering textiles in automatic washing machines.

Although certain embodiments of the invention have been selected for description in the examples hereinafter, it will be appreciated by those skilled in the art that these examples are merely illustrative of, but do not in any way limit, the scope of the present invention which is defined in the appended claims.

EXAMPLE AND COMPARATIVE EXAMPLES

To prepare a detergent having the composition indicated below, an aqueous paste containing 50% by weight of sodium dodecylbenzene sulfonate was mixed with a nonionic ethoxylated surfactant (the phrase "+7 EO" refers to the number of moles of ethylene oxide added per mole of oxoalcohol). Then the alcohol solvents, the fatty acid diethanolamide, the fatty acid required for soap formation, the polyphosphonic acid sequestering agent (diethylene triamine pentamethylene phosphonic acid) and the citric acid were added. After neutralization with sodium hydroxide and triethanolamine, the remaining constituents (enzyme, optical brightener, dye, opacifier, perfume and water) were added (the amounts are % by weight, based on the dry weight of the additive). In comparative example 1, the oleic acid diethanolamide was replaced by equal parts of alkylbenzene sulfonate and the nonionic surfactant.

| Detergent Composition | Example 1 | Comparative Example 1 |
|---|---|---|
| Na dodecylbenzene sulfonate | 7.5 | 12.5 |
| $C_{12}$—$C_{15}$ oxoalcohol +7 EO | 10.0 | 15.0 |
| Ethanol | 5.0 | 5.0 |
| Propanol | 7.0 | 7.0 |
| Oleic acid diethanolamide | 10.0 | — |
| Coconut oil fatty acid | 6.0 | 6.0 |
| Oleic acid | 7.3 | 7.3 |
| Citric acid | 0.5 | 0.5 |
| Polyphosphonic acid sequestrant | 0.5 | 0.5 |
| NaOH | 2.1 | 2.1 |
| Triethanolamine | 5.0 | 5.0 |
| Enzyme | 0.7 | 0.7 |
| Additives (optical brightener, dye, opacifier, perfume) | 0.6 | 0.6 |
| Water | balance | balance |

The cleaning and softening effects of the detergents of Example 1 and Comparative Example 1 were tested under identical simulated household washing conditions. White cotton fabric samples, which had been soiled under standarized conditions with skin fat, pigment soil and stained with red wine, tea and bilberries, were loaded with 3 kg of ballast laundry and washed at 60° C. and at 90° C. in a domestic automatic washing machine (capacity 4 kg). The washing time, including heat-up time, was 20 minutes. The detergent concentration of the wash liquor was 7.5 g/liter. The ratio of fabric weight (in kg) to wash liquor (in liters) was 1:10 and the hardness of the tap water was 16° dH (160 mg CaO per liter). After three rinses, the laundry was spun and dried. The degree of cleaning (whiteness) of the samples was photometrically determined through reflectance spectrometry and the hand of the samples was assessed. The average value of 9 reflectance spectrometry remission measurements and 9 hand assessments was determined.

The softening properties of the detergent of Example 1 were assessed and compared against additional samples which had been washed under identical conditions with: (i) a standard commercial high-performance detergent without further after-treatment (Comparative Example 2); and (ii) a standard commercial high-performance detergent containing a conditioning additive based on a cocoalkyl trimethylammonium salt (Comparative Example 3). The hand properties of all of the samples were assessed after one washing and again after five washings. The hand properties of terry cloth samples which had been soiled and washed once at 90° C. were also assessed. The results are presented in the following tables, demonstrating the superiority of the detergents of the present invention.

CLEANING ABILITY

A higher remission value represents higher cleaning ability than a lower remission value.

Primary washing power (remission values)

| Washing temperature °C. | Soil Type: Pigment/fat: Example 1 | Pigment/fat: Comparative Example 1 | Colored stains: Example 1 | Colored stains: Comparative Example 1 |
|---|---|---|---|---|
| 60 | 47.4 | 46.0 | 59.4 | 58.8 |
| 90 | 53.9 | 53.5 | 61.8 | 60.5 |

Softening Ability (0 is the poorest hand assessment, 6 is the highest hand assessment; A hand of 6 corresponding to the softness achieved by a highly effective conditioner added during the 4th rinse.)

| Washing temperature °C. | Example 1 | | Comparative Example 1 | | Comparative Example 2 | | Comparative Example 3 | |
|---|---|---|---|---|---|---|---|---|
| | No. of Wash Cycles (x) | | | | | | | |
| | 1x | 5x | 1x | 5x | 1x | 5x | 1x | 5x |
| 60 | 3.0 | 3.2 | 0.2 | 0.1 | 0 | 0 | 0.3 | 0.4 |
| Terry Cloth 90 | 3.1 | — | 0.2 | — | 0 | — | 0.4 | — |

Although the present invention has been described in terms of a number of specific examples and embodiments thereof, it will be appreciated by those skilled in the art that a wide variety of equivalents may be substituted for the specific parts and steps of operation described herein, all without departing from the spirit and scope of the present invention, as defined in the appended claims.

We claim

1. A liquid detergent consisting essentially of (a) from about 5 to about 15% by weight of a sodium alkylbenzene sulfonate, said sodium alkylbenzene sulfonate having a linear alkyl group containing from 10 to 14 carbon atoms;

(b) from about 7 to about 20% by weight of a water-soluble ethoxylated alcohol containing from 12 to 18 carbon atoms in the alcohol moiety and from 5 to 10 glycol ether groups;

(c) a water-soluble soap prepared from fatty acids having from 12 to 18 carbon atoms in an amount of from about 6 to about 16% by weight on the basis of the fatty acid content;

(d) from about 7 to about 15% by weight of a fatty acid diethanolamide prepared from fatty acids having from 16 to 18 carbon atoms wherein at least 50% of said fatty acids are monounsaturated.

(e) from about 0.2 to about 3% by weight of a sequestering agent selected from the group consisting of polycarboxylic acid-type sequestering agents, polyphosphonic acid-type sequestering agents and mixtures thereof;

(f) from about 5 to about 15% by weight of a water-miscible organic solvent; and (g) water; wherein the ratio of (a) to (b) is in the range of 1:1 to 1:2, the ratio of (a) to (c) is in the range of 1:1 to 1:2, and the ratio of (a) to (d) is in the range of 1:1.5 to 1:2.5.

2. The detergent of claim 1, wherein component (a) consist essentially of sodium dodecylbenzene sulfonate in an amount of from about 6 to about 10% by weight.

3. The detergent of claim 1, wherein component (b) consists essentially of an ethoxylated alcohol selected from the group consisting of ethoxylated fatty alcohols, ethoxylated fatty oxoalcohols and mixtures thereof in an amount of from about 8 to about 15% by weight, said ethoxylated alcohol containing from 12 to 16 carbon atoms in the alcohol moiety and from 6 to 9 glycol ether groups.

4. The detergent of claim 1, wherein component (c) consists essentially of a sodium, potassium, or triethanolamine soap derived from an acid selected from the group consisting of coconut oil fatty acids, oleic acid and mixtures thereof, in an amount of from about 8 to about 15% by weight based on the fatty acid.

5. The detergent of claim 1, wherein component (d) consists essentially of a fatty acid diethanolamide in an amount of from about 8 to about 15% by weight, said fatty acid diethanolamide prepared from fatty acids comprising at least 65% by weight oleic acid.

6. The detergent of claim 1, wherein component (e) consists essentially of a water-soluble salt of an acid selected from the group consisting of citric acid, ethylene diamine tetra-(methylenephosphonic acid), diethylene triamine penta-(methylenephosphonic acid) and mixtures thereof.

7. The detergent of claim 1, wherein (f) consists essentially of a mixture of ethanol and propylene glycol in an amount of from about 7 to about 13% by weight.

8. The detergent of claim 1, having a pH of from about 7.2 to about 9.

9. The detergent of claim 1, wherein component (b) has a hydrophilic-lipophilic balance value of from about 9 to about 14.

10. The detergent of claim 1, wherein component (b) consists essentially of ethoxylated coconut oil fatty alcohol from which alcohols containing 10 or less carbon atoms have been separated.

11. The detergent of claim 1, wherein component (d) consists essentially of a fatty acid diethanolamide prepared from oleic acid, palmitoleic acid, and mixtures thereof with corresponding palmitic acid and stearic acid derivatives.

12. A liquid detergent consisting essentially of:

(a) from about 5 to about 15% by weight of a sodium alkylbenzene sulfonate, said sodium alkylbenzene sulfonate having a linear alkyl group containing from 10 to 14 carbon atoms;

(b) from about 7 to about 20% by weight of a water-soluble ethoxylated alcohol containing from 12 to 18 carbon atoms in the alcohol moiety and from 5 to 10 glycol ether groups;

(c) a water-soluble soap prepared from fatty acids having from 12 to 18 carbon atoms in an amount of from about 6 to about 16% by weight on the basis of the fatty acid content;

(d) from about 7 to about 15% by weight of a fatty acid diethanolamide prepared from fatty acids having 16 to 18 carbon atoms wherein at least 50% of said fatty acids are monounsaturated.

(e) from about 0.2 to about 3% by weight of a sequestering agent selected from the group consisting of polycarboxylic acid-type sequestering agents, polyphosphonic acid-type sequestering agents and mixtures thereof;

(f) from about 5 to about 15% by weight of a water-miscible organic solvent;

(g) from about 0.1 to about 1.5% by weight of an enzyme;

(h) triethanolamine present in an amount to adjust the pH of said detergent to within the range of about 7.2 to about 9; and (i) water;

wherein the ratio of (a) to (b) is in the range of 1:1 to 1:2, the ratio of (a) to (c) is in the range of 1:1 to 1:2, and the ratio of (a) to (d) is in the range of 1:1.5 to 1:2.5.

* * * * *